US007010946B2

(12) United States Patent
Hahn

(10) Patent No.: US 7,010,946 B2
(45) Date of Patent: Mar. 14, 2006

(54) LATCH APPARATUS

(75) Inventor: Kevin Hahn, Rice Lake, WI (US)

(73) Assignee: Truth Hardware Corporation, Owatonna, MN (US)

( * ) Notice: Subject to any disclaimer, the term of this patent is extended or adjusted under 35 U.S.C. 154(b) by 27 days.

(21) Appl. No.: 10/441,974

(22) Filed: May 19, 2003

(65) Prior Publication Data

US 2004/0232705 A1 Nov. 25, 2004

(51) Int. Cl.
*E05B 59/00* (2006.01)

(52) U.S. Cl. ..... 70/111; 70/141; 70/150; 70/470; 70/483; 292/169.14

(58) Field of Classification Search ..... 292/165, 292/169, 37, 150, 159, 169.14, 169.22, DIG. 24; 70/107, 111, 130–131, 133, 141, 144, 110, 70/145, 150, 283, 210, 467, 470, 483–485
See application file for complete search history.

(56) References Cited

U.S. PATENT DOCUMENTS 446,101 A * 2/1891 Ludwig ..... 70/107
451,709 A * 5/1891 Fey ..... 70/150
1,041,388 A * 10/1912 Wegmann ..... 70/107
2,028,672 A * 1/1936 Kubina ..... 70/107
2,179,352 A * 11/1939 Rightmyer ..... 292/169
2,189,405 A * 2/1940 Rightmyer ..... 292/169
3,477,755 A * 11/1969 Nolin et al. ..... 292/229
5,044,184 A * 9/1991 Herbers et al. ..... 70/277
5,083,448 A * 1/1992 Karkkainen et al. ..... 70/277
5,673,948 A * 10/1997 Karpisek ..... 292/138
6,622,535 B1 * 9/2003 Chiang et al. ..... 70/107

FOREIGN PATENT DOCUMENTS

DE 3400618 A1 * 7/1985

* cited by examiner

*Primary Examiner*—Brian E. Glessner
*Assistant Examiner*—Christopher Boswell
(74) *Attorney, Agent, or Firm*—Merchant & Gould, P.C.

(57) ABSTRACT

The invention generally relates to a latch apparatus having a locking live bolt. One embodiment of the invention is a latch apparatus having a housing with opposed plates that are spaced apart and secured to each other by support arms formed from the plates. A live bolt of the apparatus is slidably mounted in the housing and horizontally actuated between an extended and a retracted position. A live bolt hub is mounted in the housing and actuates the live bolt. A slide, actuated by a rotatable cam, is mounted in the housing and moves vertically between a first position and a second position. In the first position the slide is disengaged from the live bolt, and in the second position the slide locks the live bolt in an extended position.

21 Claims, 8 Drawing Sheets

LATCH APPARATUS

BACKGROUND OF THE INVENTION

1. Field of the Invention

The present invention is directed to a latch apparatus, and in particular to a latch with a locking live bolt that is locked in an extended position by a movable slide positioned behind the extended live bolt in the latch housing.

2. Related Art

Lockable live bolts are well known and have been used for many years. Typically, the locking mechanism that locks the live bolt is housed away from the live bolt, such as a handle that actuates the live bolt. The live bolt hub is typically mounted in the apparatus housing at a position below the live bolt, and the dead bolt is generally mounted at a position below the live bolt and the live bolt hub. A dead bolt cam actuates the dead bolt and is typically mounted in the housing below the dead bolt.

This configuration of latch apparatus components requires a relatively long apparatus housing in order to align all of the components for proper actuation of the live bolt and dead bolt while maintaining a specified depth that the apparatus extends into the door. A longer apparatus housing requires additional housing materials and support features as compared to a latch apparatus without one of the above-mentioned components.

The need for aligning the latch apparatus components in this particular order has, over time, helped to establish a loosely followed industry standard for the placement of live bolt handles and dead bolts relative to the position of the live bolt in the apparatus housing. However, in certain applications, it may be advantageous to provide a dead bolt and its actuating members or a live bolt actuating handle in the apparatus housing above the live bolt, whereas prior art latches do not provide such an option.

An additional drawback of prior art latches is the ease in which a live bolt can be retracted without actuating the live bolt handle. For example, in some configurations where the door to which the apparatus is mounted is "locked" only by locking the live bolt handle (not by locking the live bolt itself or a dead bolt), the live bolt may be forced into a retracted position by pushing inward on the extended end of the live bolt. The live bolt is retractable in this scenario even though the handle is locked. Such a method may be used by a person opening a "locked" door when they do not have access to the live bolt handle or a key to unlock the live bolt handle. A latch apparatus addressing these and other known disadvantages would be an important advance in the art.

SUMMARY OF THE INVENTION

Generally, the invention relates to a latch apparatus having a locking live bolt. One embodiment of the invention is a latch apparatus having a housing with opposed plates that are spaced apart and secured to each other by support arms formed from the plates. A live bolt of the apparatus is slidably mounted in the housing and horizontally actuated between an extended and a retracted position. A live bolt hub is mounted in the housing and actuates the live bolt. A slide, actuated by a rotatable cam, is mounted in the housing and moves vertically between a first position and a second position, wherein at the first position the slide is disengaged from the live bolt, and in the second position the slide locks the live bolt in an extended position. The latch apparatus is thus configured to provide a relatively simple mechanical configuration for locking a live bolt, thus eliminating the need for a dead bolt or other device for locking a door to which the latch apparatus is mounted.

These features of novelty and various other advantages that characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

BRIEF DESCRIPTION OF THE DRAWINGS

The invention may be more completely understood in consideration of the following detailed description of various embodiments of the invention in connection with the accompanying drawings, wherein like numerals represent like parts throughout several views, in which.

Figure 1:
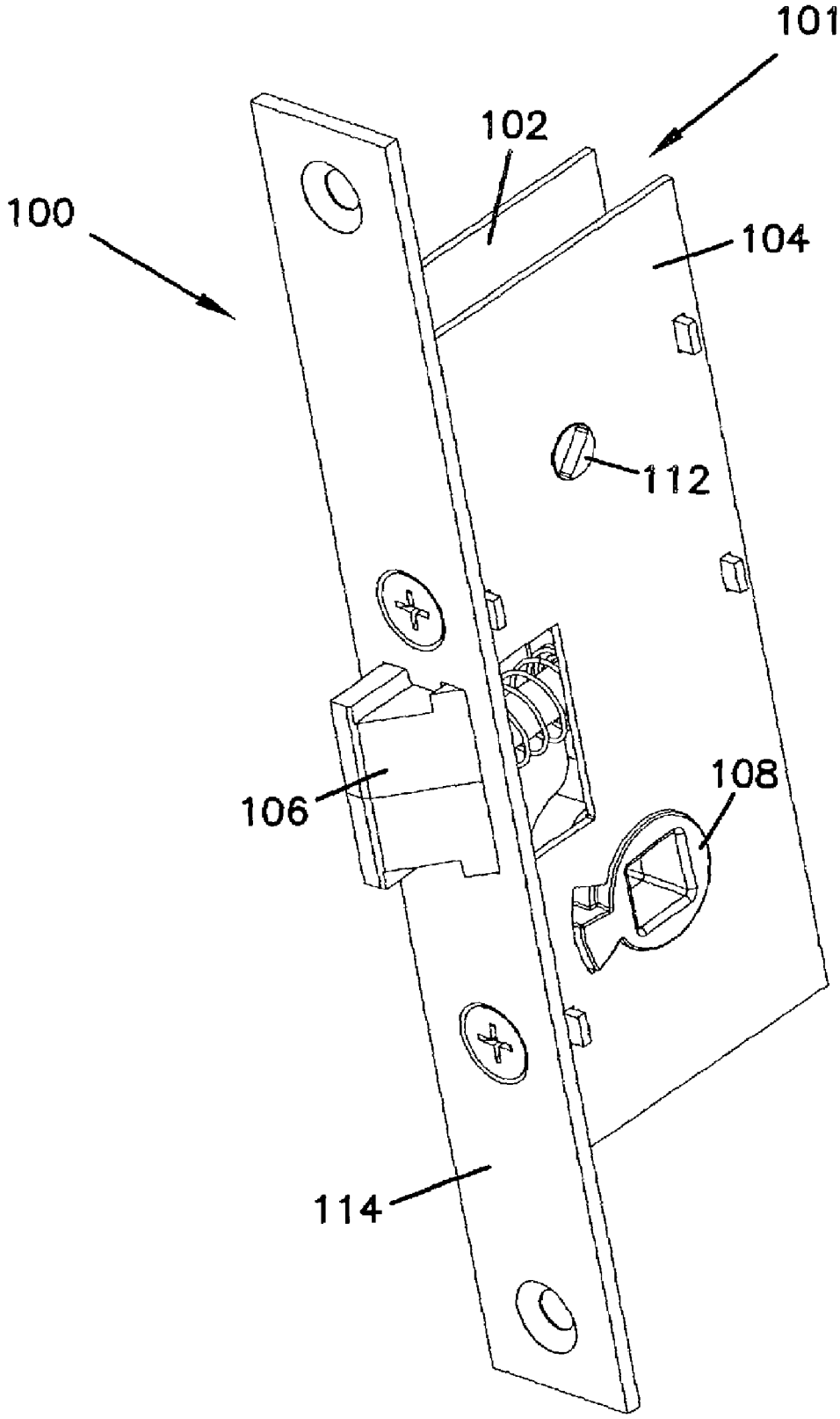
FIG. 1 is a perspective view of an assembled latch apparatus, according to the invention.

While the invention is amenable to various modifications and alternative forms, the specifics thereof have been shown by way of example in the drawing and will be described in detail. It should be understood, however, that the intention is not to limit the invention to the particular embodiments described. On the contrary, the intention is to cover all modifications, equivalents, and alternatives falling within the spirit and scope of the invention.

DETAILED DESCRIPTION OF THE PREFERRED EMBODIMENT

The present invention is believed to be applicable to door latches, as for example, a latch apparatus for a storm door. In particular, the present invention is directed to a latch apparatus with a locking live bolt wherein a locking slide, actuated by a locking slide cam, engages a rear portion of a live bolt to lock the live bolt in an extended position. While the present invention may not be so limited, an appreciation of various aspects of the invention will be gained through a discussion of the examples provided below.

The latch apparatus of the present invention overcomes many of the shortcomings of the prior art by providing a simple mechanical configuration for locking a live bolt without utilizing otherwise complicated locking mechanisms in a handle that typically actuates the live bolt. The present invention accomplishes this objective by providing a locking slide that moves behind the live bolt when the live bolt is in an extended position, to prohibit movement of the live bolt between extended and retracted positions.

Figure 2:
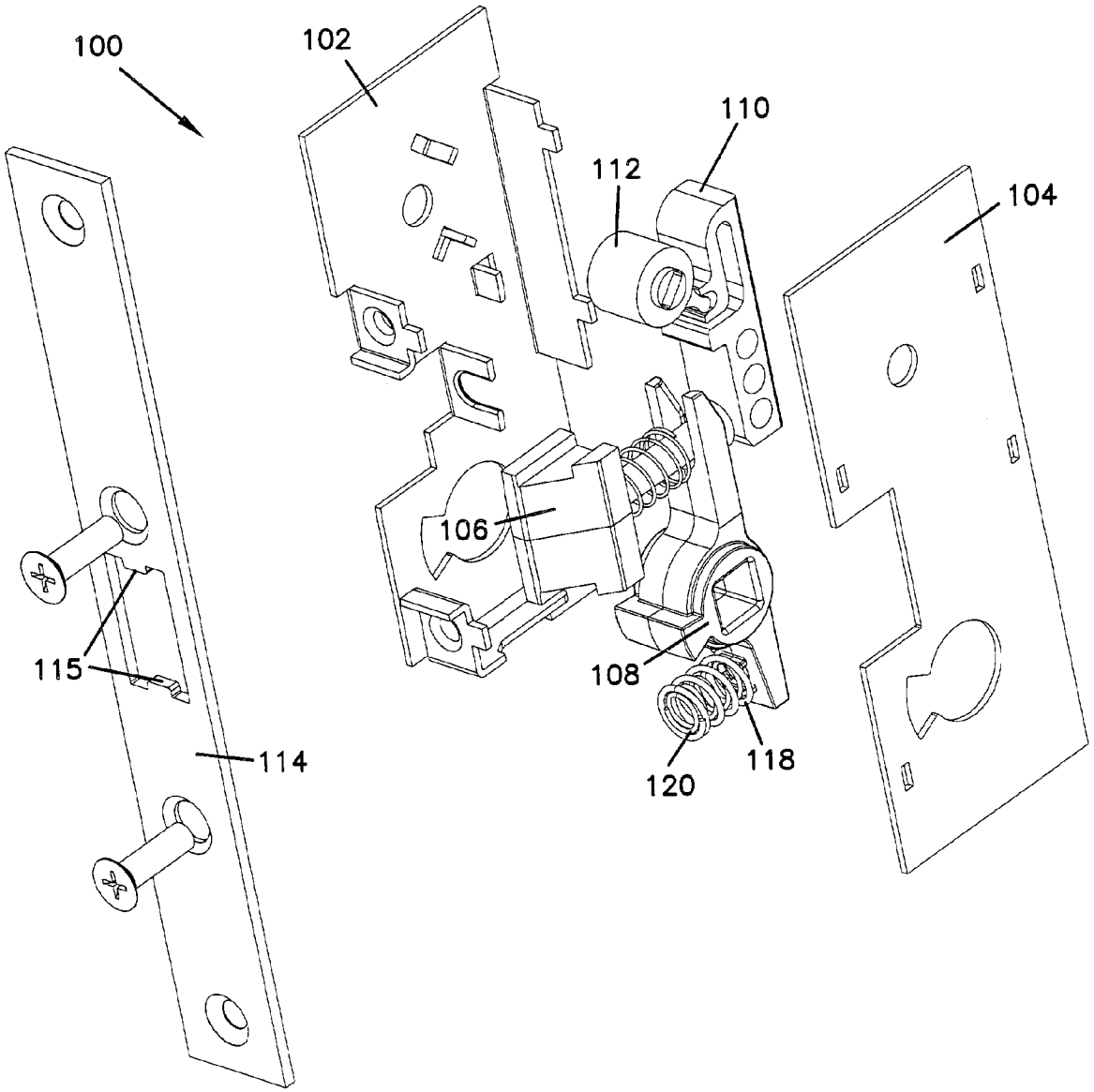
FIG. 2 is an exploded perspective view of the latch apparatus of FIG. 1.

One example of a latch apparatus 100 of the present invention includes first and second housing plates 102 and 104, a live bolt 106, a live bolt hub 108, a locking slide 110, and a locking slide cam 112, as shown assembled in FIG. 1 and disassembled in FIG. 2. Live bolt spring 116 and first and second hub springs 118 and 120 assist in biasing the live bolt 106 in an extended position. When secured together, first and second plates 102 and 104 create a latch apparatus housing for mounting or retaining the other apparatus components. Components 102–112 will be explained in greater detail with regard to FIGS. 5–13.

Figure 3:
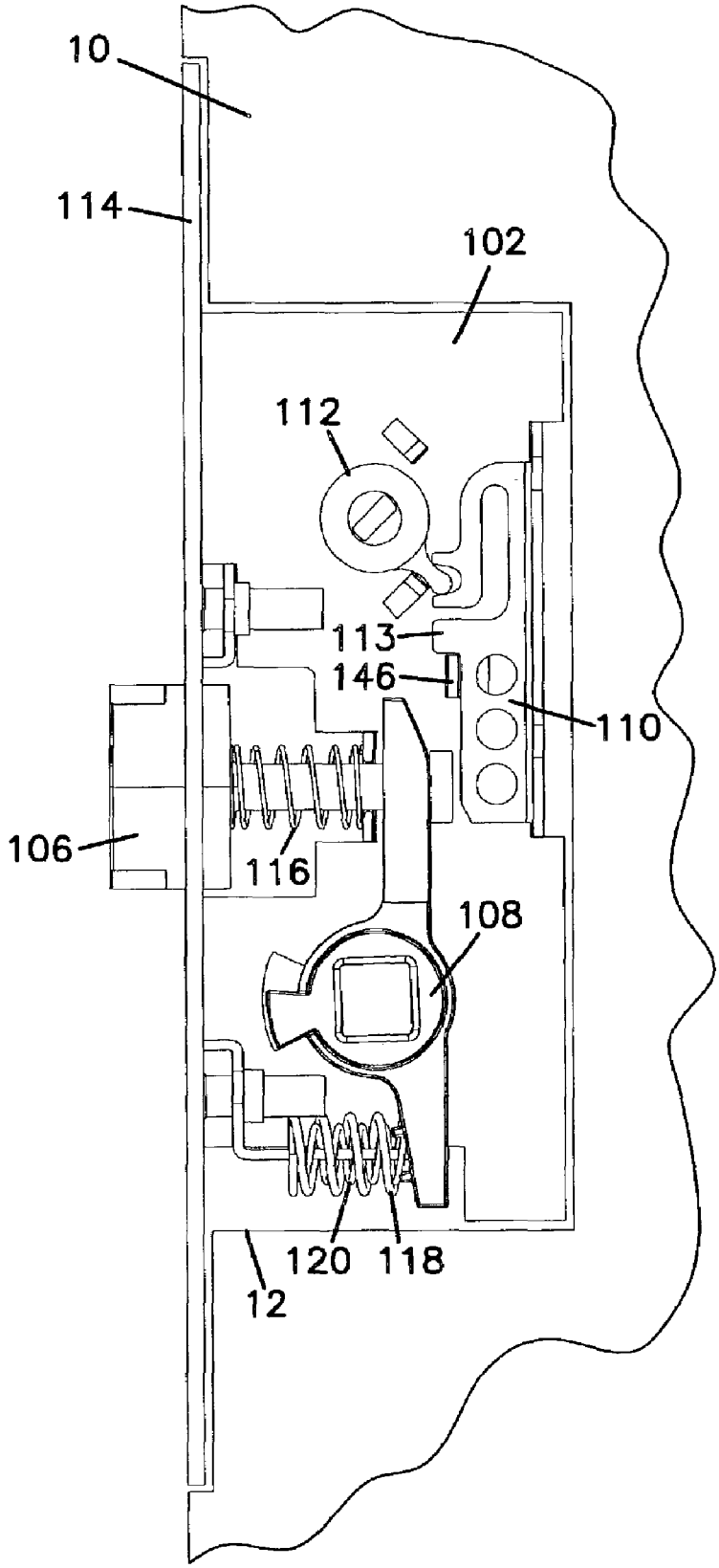
FIG. 3 is a side plan view of the latch apparatus of FIG. 1 with a side plate removed and the locking slide in a locked position.
Figure 4:
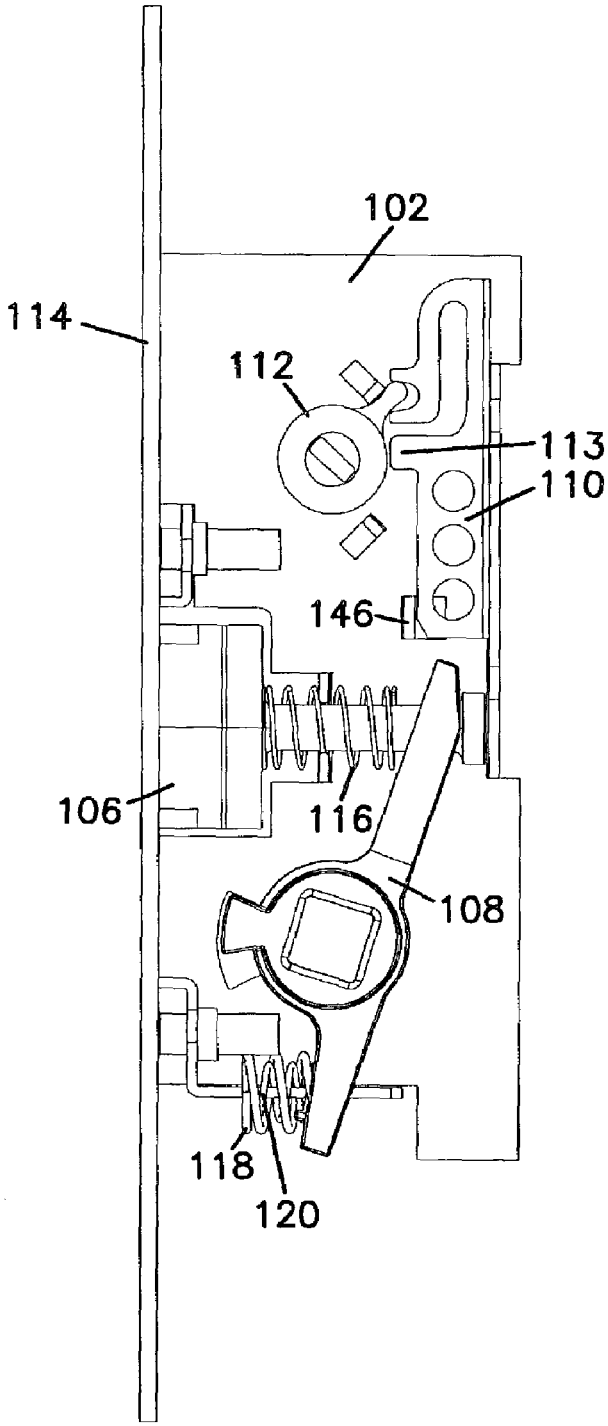
FIG. 4 is a side plan view of the latch apparatus of FIG. 1 with a side plate removed and the locking slide in an unlocked position.

FIGS. 3 and 4 illustrate the latch apparatus in the locked and unlocked positions, respectively. In FIG. 3, live bolt 106 is shown biased in an extended position by springs 116, 118 and 120. When the live bolt is in the extended position, there is space in the apparatus housing behind live bolt 106 for an object to be inserted, such as locking slide 110. FIG. 3 illustrates locking slide 110 in a first, locking position such that live bolt 106 is prohibited from moving into a retracted position in the apparatus housing.

FIG. 4 illustrates locking slide 110 in a second, unlocked position after having been actuated into the unlocked position by locking slide cam 112. With locking slide 110 in the unlocked position, live bolt hub 108 is able to move live bolt 106 from an extended position (see FIG. 3) to a retracted position (see FIG. 4) in the apparatus housing. Thus, the invention provides a simple mechanical configuration for locking live bolt 106 in an extended position and disengaging the locking slide from the live bolt to enable movement of live bolt 106 to a retracted position.

Figure 5:
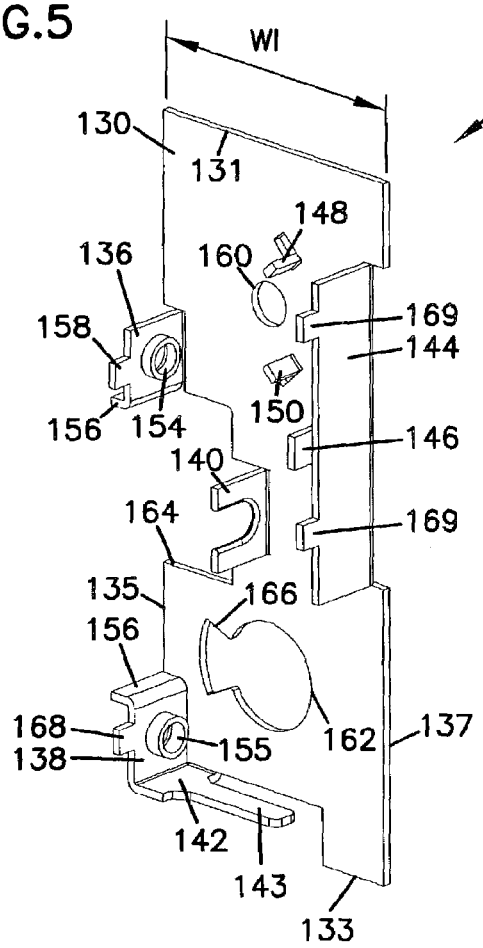
FIG. 5 is a perspective view of a first side plate for the latch apparatus of FIG. 1.
Figure 6:
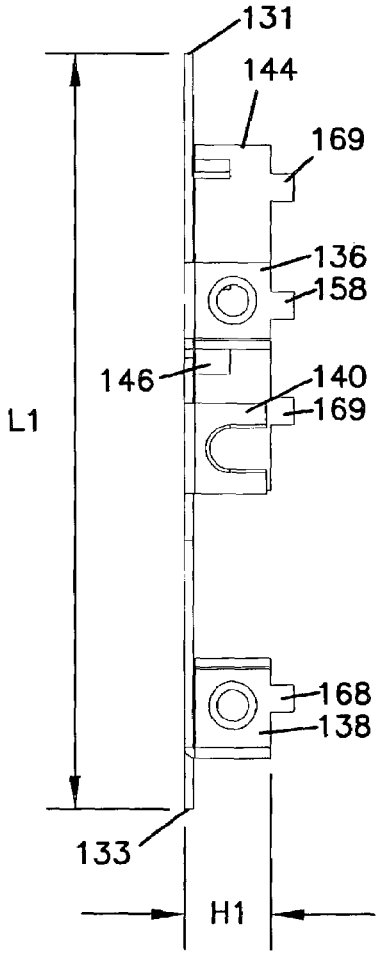
FIG. 6 is a side plan view of the first side plate of FIG. 5.

First housing plate 102 is illustrated in detail in the perspective view of FIG. 5 and the side plan view of FIG. 6. Plate 102 includes a base member 130 having first and second ends 131 and 133, first and second sides 135 and 137, a length L1 between first and second ends 131 and 133, and a width W1 between first and second sides 135 and 137. First plate 102 includes first and second support members 136 and 138 positioned near first side 135, a live bolt support member 140, a live bolt hub support member 142, a third support member 144 positioned near second side 137, a locking slide support member 146, and cam stops 148 and 150. First, second and third support members 136, 138 and 144 have a height H1 that defines a spacing in the housing between first and second plates 102 and 104.

Support members 136 and 138 include openings 154 and 155, respectively, that are configured to receive a fastener for fastening faceplate 114 (see FIG. 1) to the apparatus housing. Support members 136 and 138 also include an angled portion 156, preferably angled at about 90 degrees relative to the remaining portions of support members 136 and 138. Angled portions 156 assist in supporting faceplate 114 when securing the faceplate to the apparatus housing, and also strengthen support members 136 and 138 from bending, for example, from forces due to fastening faceplate 114 to first plate 102. Support members 136, 138 and 144 also include attachment tabs 158, 168 and 169, respectively, that assist in attaching second plate 104 to first plate 102. In the illustrated embodiment, attachment tabs 158, 168 and 169 are deformable and sized to fit through attachment openings on second plate 104.

The attachment tabs 158, 168 and 169 are intended to deform under a deforming load to create an interference fit between attachment openings in plate 104, the attachment tabs 158, 168 and 169 themselves, and support members 136, 138 and 144 to secure the first and second plates together to form the apparatus housing. In alternative embodiments, support members 136, 138 and 144, as well as other support members of the latch apparatus, may be configured with other devices for securing two members together. For example, the support members may be configured to receive a fastener, such as a rivet or screw that is inserted through openings in second plate 104 to secure second plate 104 to first plate 102.

First plate 102 also includes a live bolt support member 140 that is shaped to receive a portion of live bolt 106. Live bolt support member 140 is positioned on base member 130 near a midpoint between first and second sides 135 and 137, and may extend at about 90 degrees (perpendicular) relative to base member 130. Live bolt support member 140 may serve several purposes, including stabilizing live bolt 106 as it moves between retracted and extended positions, and providing a surface against which live bolt spring 116 may act to bias live bolt 106 in an extended position. Lastly, live bolt support member 140 may act as a position stop against which a portion of live bolt hub 108 or live bolt 106 engages to prohibit the live bolt from being removed from the apparatus housing.

Live bolt hub support member 142 is positioned near second end 133 and is aligned substantially parallel to the direction of motion of live bolt 106. Support member 142 includes a track or arm 158 that receives and retains springs 118 and 120 and is insertable through an opening in live bolt hub 108. Thus, support member 142 acts as a track for retaining live bolt hub 106 when it is actuated while also retaining springs 118 and 120. In the embodiment illustrated in FIGS. 2–6, support member 142 is integrally formed with support member 138, but may be, in alternative embodiments, formed separately from support member 138 and then secured to member 138. In further alternative embodiments, other features for biasing may be used in place of springs 118 and 120 to bias live bolt hub in a given direction.

Support members 144 and 146 are positioned on base member 130 near second side 137 and are spaced apart a specified distance to act as track or retaining surfaces for movement of locking slide 110 between locked and unlocked positions. The size, shape and position of members 144 and 146 may vary in alternative embodiments according to the design specifications of the locking slide, the housing, the locking slide cam and the live bolt, among other considerations.

Cam stops 148 and 150 provide position stops for cam 112 as the cam actuates locking slide 110 between locked and unlocked positions. Cam stops 148 and 150 may be of various shapes and sizes so long as they function to stop the rotation of cam 112. In alternative embodiments, there may be only one or no cam stops in the apparatus housing depending upon the type of cam used in the apparatus and how the cam is actuated.

First plate 102 includes a recess 160 for cam 112, an opening 162 for live bolt hub 108, and an opening 164 for live bolt 106. Opening 160 is sized to receive a portion of cam 112 and functions to align cam 112 properly between first and second plates 102 and 104 while providing radial support for the cam as it rotates to actuate locking slide 110.

Opening 162 has a central opening for receiving a base portion of live bolt hub 108, and includes an additional cam opening 166 for receiving a cam protrusion of the live bolt hub. Opening 162 also acts to align hub 108 between first and second plates 102 and 104 while providing radial support as the hub actuates live bolt 106 between extended and retracted positions. Cam opening 166 provides a position stop for the hub as it rotates to actuate the live bolt.

Opening 164 is configured to receive a portion of live bolt 106 as it moves between retracted and extended positions. Opening 164 provides lateral support for the live bolt and acts as a track to align the live bolt to ensure straight and smooth motion of the live bolt.

In prior art embodiments, some of the support members of first plate 102 were separate pieces that were attached separately to the first plate by some form of attachment, for example, using adhesives, fasteners, or interference fits. In the present invention, all support members and protrusions associated with first plate 102 may be integrally formed from base member 130, so that the support members and base member are monolithic. The support members may, for example, be formed by stamping out the shape of those protrusions from base member 130 and then, in a second step, bending those cutout shapes into a position perpendicular to the plane of base member 130. As a result of forming the protrusions in this manner, it is not necessary to separately attach these support members to first plate 102, thus reducing at least one step when assembling the latch apparatus housing.

Figure 7:
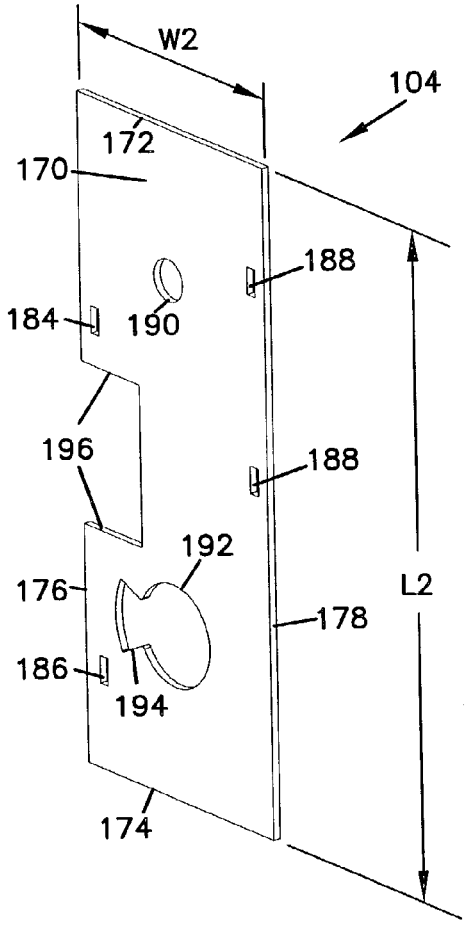
FIG. 7 is a perspective view of a second side plate for the latch apparatus of FIG. 1.

Second housing plate 104 is illustrated in detail in the perspective view of FIG. 7. Plate 104 includes a base member 170 having first and second ends 172 and 174, first and second sides 176 and 178, a length L2 between first and second ends 172 and 174, and a width W2 between first and second sides 176 and 178. Second plate 104 also includes attachment openings 184 and 186 for receiving attachment tabs 158 and 168 of first and second support members 136 and 138, respectively. Attachment openings 188 are positioned near second side 178 and are configured to receive attachment tabs 169 of third support member 144. The size and shape of cam opening 190 is similar to that of cam opening 160 in first plate 102 and is aligned with cam opening 160 so that cam 112 may be properly aligned between first and second plates 102 and 104. Cam opening 190 also provides radial support for cam 112 as it rotates within opening 190.

Second side 104 further includes a live bolt hub opening 192 that receives a base portion of hub 108. Hub opening 192 includes a cam opening 194 for receiving a cam protrusion portion of hub 108. Opening 192 assists in aligning hub 108 properly between first and second plates 102 and 104 and is coaxially aligned with hub opening 162 when the first and second plates are secured together. Cam opening 194 may provide a position stop for a hub protrusion portion of hub 108 to limit the rotation of the live bolt hub as it rotates to actuate the live bolt.

Second plate 104 also includes a live bolt opening 196 near first side 176 that is sized to receive a portion of live bolt 106. Opening 196 may provide lateral support for the live bolt and align the live bolt as it moves between extended and retracted positions. In alternative embodiments of the present invention, any of support members 136–150 may be integrally formed from plate 104, rather than plate 102, so that the support members are monolithic with the second plate 104.

Figure 8:
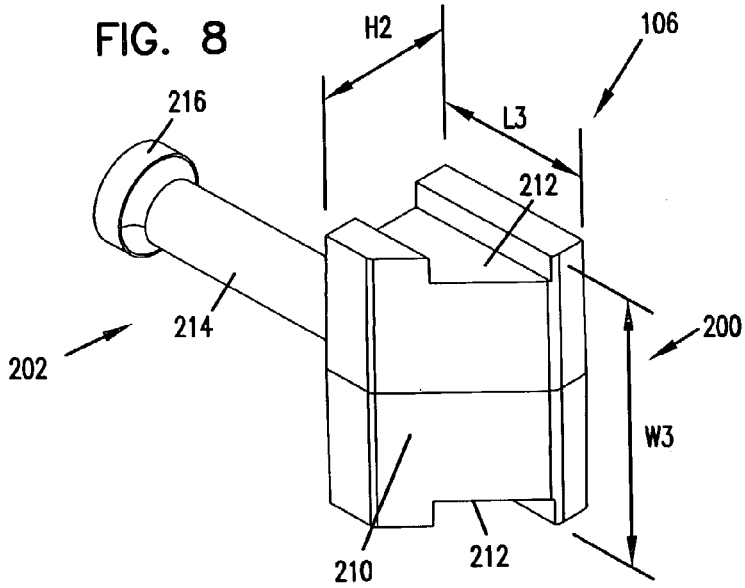
FIG. 8 is a perspective view of a live bolt for the latch apparatus of FIG. 1.

Live bolt 106 is illustrated in detail in the perspective view of FIG. 8. Live bolt 106 includes a head portion 200 and a tail portion 202. Head portion 200 has a width W3, a length L3, and a height H2. Head portion 200 also includes a slanted face portion 210 that engages a doorframe when closing a door to which latch apparatus 100 is mounted. Head portion 200 further includes recesses 212 that engage an alignment tab 115 in faceplate 114 (see FIG. 2). Recesses 212 assist in aligning and supporting live bolt 106 as it moves between retracted and extended positions.

Figure 12:
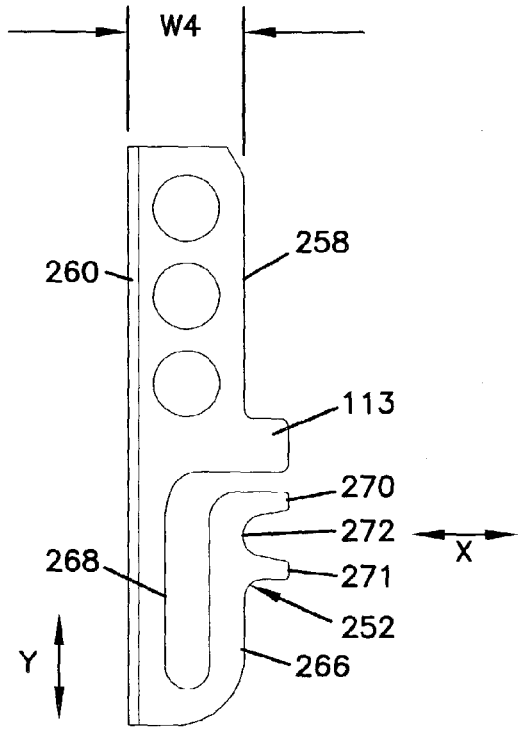
FIG. 12 is a side plan view of the locking slide of FIG. 11.

Tail portion 202 includes an elongate member 214 and a cap 216. Elongate member 214 is secured to head portion 200 at a symmetrical, central position on head portion 200, as illustrated in FIG. 12. In alternative embodiments, elongate portion 214 may be positioned at a position offset from a central position of head portion 200. Elongate member 214 is configured to engage live bolt support member 140. Cap 216 is secured to elongate member 214 and is intended to engage a portion of live bolt hub 108 so that the hub may actuate the live bolt between extended and retracted positions. Cap 216 also enables retention of live bolt 106 within the apparatus housing.

Live bolt 106 may be made of a variety of different materials, preferably with qualities such as resistance to wear, strength and durability. In one embodiment, face 210 or all of head portion 200 is made of a synthetic or other wear resistant material. As wear is common for live bolts after undergoing extensive use, it may be advantageous to provide at least a portion of head portion 200, such as face 210 or recesses 212, with a material that has a high resistance to wear. In one embodiment, the entire live bolt 106 is made of a metal, a metal alloy, a synthetic material such as nylon or other polymer, or a combination of these materials. The various portions of live bolt 106 are integrally formed so that they are monolithic, for example by casting or injection molding the live bolt as a single piece. In alternative embodiments, the various portions of live bolt 106 may be secured together by adhesives, welding, ultrasonic welding, or the like means of attaching pieces together.

Figure 9:
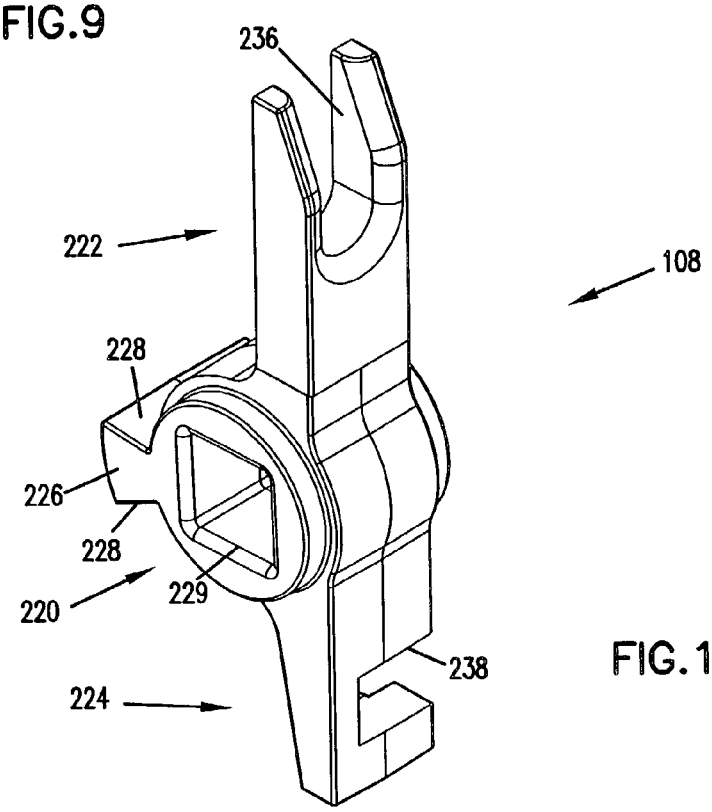
FIG. 9 is a perspective view of a live bolt hub for the latch apparatus of FIG. 1.
Figure 10:
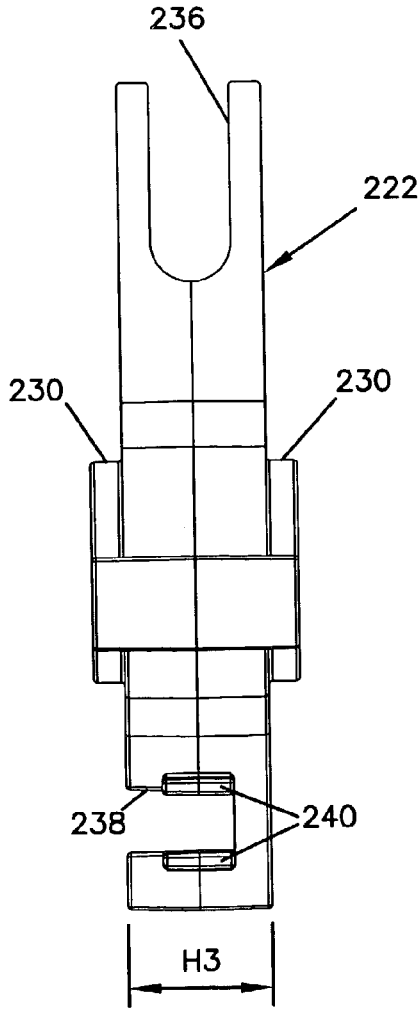
FIG. 10 is a back plan view of the live bolt hub of FIG. 9.

Live bolt hub 108 is illustrated in detail in the perspective view of FIG. 9 and the side plan view of FIG. 10. Live bolt hub 108 includes a base portion 220, a live bolt engagement portion 222, and a rocker arm portion 224. Base portion 220 includes a cam protrusion 226 having an engagement surface 228 for engaging hub cam openings 162 and 192 of respective first and second plates 102 and 104. Base 220 also includes an opening 229 that receives an actuating member, for example, a handle shaft, for actuating the live bolt hub. Base 202 also includes protrusions 230 that have a smaller diameter than base portion 220, and are configured to be inserted into hub openings 162 and 192 of the first and second plates 102 and 104, respectively. Protrusions 203 assist in aligning the live bolt hub in a proper actuating position between the first and second plates. Live bolt hub 108 also includes an actuating arm 222 having live bolt interface surface 234 and live bolt support member interface surface 232. Surface 234 may be slanted relative to surface 232, to account for the change in relative position between surface 234 and cap 216 on the live bolt as the live bolt moves between extended and retracted positions. A slanted surface may provide additional surface area for contact between the live bolt hub and live bolt cap 216, resulting in improved smoothness in motion of live bolt 106 between extended and retracted positions.

Typically, actuating portion 222 includes a slot 236 that is configured to receive elongate portion 214 of the live bolt. Slot 236 is smaller than the size of cap 216, thus capturing the live bolt in the apparatus housing, particularly when support member 140 is also supporting the live bolt.

Rocker arm portion 224 includes a slot 238 that is configured to receive support member 142 and its associated arm 158. Portion 224 also includes tabs 240 that engage one or both of springs 118 and 120 to hold them in position against rocker portion 224 during actuation of hub 108.

Figure 11:
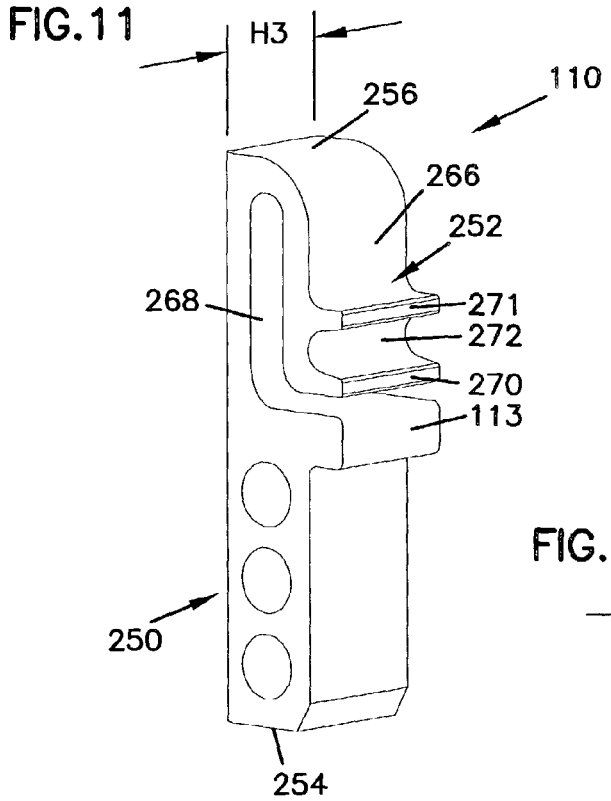
FIG. 11 is a perspective view of a locking slide for the latch apparatus of FIG. 1.

Locking slide 110 is illustrated in detail in the perspective view of FIG. 11 and the side plan view of FIG. 12. Locking slide 110 includes a locking portion 250 and an actuation portion 252. Locking portion 250 has a width W4, a height H3, and first and second sides 258 and 260. Width W4 must be no greater than the distance between live bolt cap 216 and third support member 144 when live bolt 106 is in the extended position, so that locking slide 110 is able to move into a locking position behind the extended live bolt. Width W4 is also no greater than the distance between support members 144 and 146 on first plate 102 so that the support members act as a track for capturing and retaining locking portion 250 within the apparatus housing.

When retained in the apparatus housing, second side 260 of the locking slide faces third support member 144 of plate 102, and first side 258 of the locking slide faces support member 146 of plate 102. Accordingly, actuation portion 252 of the locking slide is positioned facing cam 112 within the apparatus housing. Actuation portion 252 includes an actuation arm 266 with cam protrusions 270 and 271 formed adjacent to each other at an end of arm 266. The spaced apart cam protrusions 270 and 271 create a cam engaging surface 272 for engaging locking slide cam 112. Arm 266 may be formed by removing some material from locking slide 110 to form a slot 260. Slot 260 provides space for movement of actuation portion 252 of the locking slide in an X direction (see FIG. 12) as it is engaged by locking slide cam 112 during an actuation rotation of the cam. Arm 266 is typically flexible and resilient in the lateral direction (X), while maintaining stiffness and rigidity in a vertical direction (Y).

In alternative embodiments of locking slide 110, actuation portion 252 includes a spring biased follower, rather than a flexible arm. The spring biased follower moves when contacted by the cam to account for rotation of the cam through an actuation rotation, while allowing the cam to move the locking slide between locked and unlocked positions. One embodiment of a spring biased follower includes a follower tab that engages a tab track formed in the first or second plate of the apparatus. The cam functions to actuate the follower and its associated follower tab within the tab track to move the slide between locked and unlocked positions. Actuation portion 252 may include other actuators according to the specified design intent of a given latch apparatus, so long as the actuation portion 252 is able to transfer actuation forces from the cam to actuation portion 252 to move the locking slide 110 between locked and unlocked positions in the apparatus housing.

Figure 13:
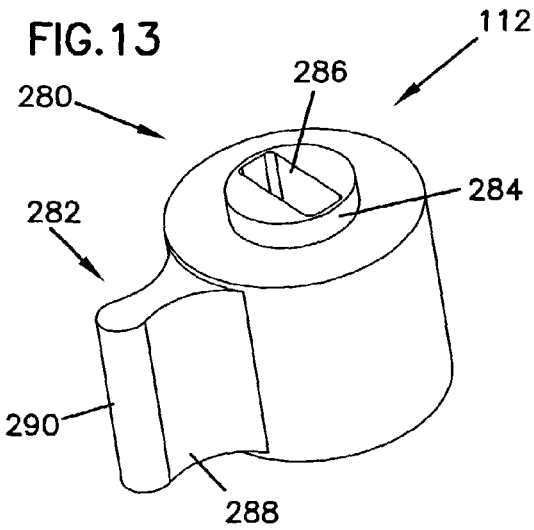
FIG. 13 is a perspective view of a locking slide cam for the latch apparatus of FIG. 1.

Locking slide cam 112 is illustrated in detail in the perspective view of FIG. 13. Cam 112 includes a base portion 280 and a cam portion 282. Base portion 280 includes an opening 286 that receives an actuating member from a key cylinder, mortise lock cylinder, thumb turn actuator, or the like, to move the cam through an actuation rotation angle. Base portion 280 also includes protrusions 284 extending from sides of the base portion. Protrusions 284 are configured to extend through cam openings 160 and 190 in first and second plates 102 and 104, respectively. Protrusions 284 may assist in aligning and supporting cam 112 during rotation of the cam.

Cam 112 also includes cam member 282 that has a cam arm 288 and a cam surface 290. Cam surface 288 extends from base portion 280 and engages cam stops 148 and 150 on the first housing plate 102 during actuation rotation of the cam. Cam stops 148 and 150 define the angle of rotation of cam 112 within the apparatus housing (see FIGS. 3 and 4). Cam surface 290, at an end of cam arm 288, engages cam protrusions 270 and 271 and cam engaging surface 272, or a like feature on actuation portion 252 of locking slide 110. Cam surface 290 is rounded, as illustrated, to provide a smooth actuation of locking slide 110 between locked and unlocked positions.

In the embodiment illustrated in FIGS. 1–13, locking slide 110 and its associated cam 112, are positioned vertically above live bolt 106, while live bolt hub 108 is positioned vertically below the live bolt. This configuration of latch apparatus components is advantageous for improving the compactness of the apparatus and for reducing the amount of materials necessary for the apparatus housing, faceplate, etc. According to the illustrated embodiment, live bolt hub 108 and locking slide 110 require similar amounts of vertical space in the apparatus housing on either vertical side of live bolt 106. This results in an aesthetically pleasing latch apparatus that has an equally balanced, and substantially symmetrical apparatus housing about the position of live bolt 106. In the prior art, which requires a deadbolt or other locking feature to lock a door to which the latch apparatus is mounted, the deadbolt is preferably positioned below the live bolt in the apparatus housing. Accordingly, the prior art apparatus housings are not symmetrical about the live bolt and there is often additional material required to produce a functional as well as an aesthetically pleasing latch apparatus.

In an alternative embodiment, the present invention includes a locking slide that is positioned vertically below the live bolt and live bolt hub in the apparatus housing. In such an embodiment, the locking slide must be much longer than the locking slide 110 illustrated in FIGS. 1–4, 11 and 12, in order to extend vertically beyond hub 108 to engage cap 216 of the live bolt when the live bolt is in an extended position. The locking slide in this embodiment would also be required to move a further distance away from the live bolt when the slide is in an unlocked position so that the locking slide would not interfere with the actuating motion of hub 108.

In a further alternative embodiment, the live bolt hub may be positioned vertically above the live bolt and the locking slide positioned vertically below the live bolt (i.e., a 180° rotation of the apparatus components shown in FIGS. 1–13). In yet a further alternative embodiment, the live bolt hub may be positioned vertically above the live bolt and the locking slide may be positioned vertically above the live bolt hub in the apparatus housing.

In the embodiments described herein, the heights H1, H2 and H3 are comparable, with height H1 always being equal to or greater than the height of H2, H3. Height H1 is generally defined by the height of the tallest support members (support members 136, 138 and 144 in FIGS. 1–6), which in turn define the spacing between first and second plates 102 and 104. If the height of other features or components of latch apparatus 100 were greater than H1, there would be interference with plates 102 and 104, and the latch apparatus would not function properly.

When utilizing latch apparatus 100 in a storm door application, apparatus 100 is mounted to a door panel 10 that has a bore 12 or the like in the door panel to receive the apparatus (see FIG. 3). The storm door typically includes door handles, typically on both sides of the door (not shown), that actuate the latch apparatus live bolt. The storm door also includes a key cylinder or thumb turn cylinder, or both, to actuate the locking slide to lock or unlock the door.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

I claim:

1. A latch apparatus, comprising;

a housing having opposed plates, the plates being spaced apart and secured to each other by support arms;

a live bolt slidably mounted in the housing and horizontally actuated between an extended and a retracted position;

a live bolt hub mounted in the housing and contacting the live bolt to actuate the live bolt between the extended and retracted positions;

a slide mounted in the housing and moving vertically between a first position disengaged from the live bolt and a second position engaging the live bolt, the slide including a flexible arm, the flexible arm having a first end integrally formed with the slide and a second end defining a cam engaging surface; and a cam arranged and configured to engage the cam engaging surface to actuate the slide between the first position and the second position;

wherein in the first position, the live bolt is free to move between the extended and retracted positions, and in the second position, the slide locks the live bolt in the extended position.

2. The latch of claim 1 wherein the the slide further includes at least one protrusion extending from the second end towards the live bolt, the protrusion defining a portion of the cam engaging surface.

3. The latch of claim 1 wherein the slide includes first and second ends, the first end of the flexible arm extends from the first end of the slide, and the flexible arm extends from the first end of the slide towards the second end of the slide.

4. The larch of claim 3 wherein the second end of the flexible arm is not attached to the slide.

5. The latch of claim 1 further comprising a slide support member formed in the plates and supporting vertical movement of the slide.

6. The latch of claim 1 wherein the live bolt comprises a first end having a live bolt face and a second end actuated by the live bolt hub, and the slide engages the live bolt second end to lock the live bolt when the live bolt is in the extended position.

7. The latch of claim 1 wherein the plates comprise first and second plates, the first plate comprising a support member formed from the first plate and the second plate comprising a support member formed from the second plate.

8. The latch of claim 7 wherein the support members are monolithic with the first and second plates.

9. The latch of claim 7 wherein the support members are stamped from the plates and bent into a support position.

10. The latch of claim 1 wherein the plates comprise first and second plates, the first plate comprising support members formed from the first plate and the second plate has no support members.

11. The latch of claim 1 further comprising a first cam stop, wherein the cam stop limits rotation of the cam.

12. The latch of claim 11 further comprising a second cam stop, wherein the first cam stop limits rotation of the cam in a first direction and the second cam stop limits rotation of the cam in a second direction.

13. The latch of claim 1 wherein the live bolt comprises a head portion and a rail portion, and the latch further comprising a live bolt biasing member and a live bolt support member formed from the plates, and wherein the biasing member acts between the live bolt tail portion, the live bolt hub and the live bolt support member.

14. The latch of claim 1 further comprising a hub support member formed from the plates and a hub biasing member, wherein the hub biasing member acts between the hub support member and the live bolt hub.

15. The latch of claim 14 wherein the hub biasing member comprises a tension biasing member and a compression biasing member.

16. The latch of claim 14 wherein the live bolt hub further comprises a rocker arm having a first end and a second end, the first arm end actuating the live bolt and the second arm end engaging the hub support member and being biased by the hub biasing member.

17. The latch of claim 1 wherein the cam and slide me positioned vertically above the live bolt and the live bolt hub is positioned vertically below the live bolt.

18. A storm door, comprising:

a door panel;

handles;

a locking mechanism; and the latch apparatus of claim 1;

wherein the latch apparatus live bolt is actuated by the handles and the latch apparatus slide is actuated by the locking mechanism.

19. A latch apparatus, comprising;

opposed plates secured to each other, the plates forming a housing;

a live bolt slidably mounted in the housing and horizontally actuated between an extended and a retracted position;

a slide mounted in the housing and moving vertically between a first position disengaged from the live bolt, and a second position engaging the live bolt to lock the live bolt in the extended position, the slide comprising a flexible arm with a cam engaging surface; and a cam permanently mounted between the opposed plates and configured to actuate the slide between the first position and the second position, the cam including a cam arm defining a generally curved cam surface;

wherein the cam engages the cam engaging surface to bend the flexible arm while actuating the slide between the first and second positions.

20. The latch apparatus of claim 19, wherein the flexible arm is integrally formed with the slide and is secured to the slide at only one end of the flexible arm.

21. A latch apparatus, comprising;

a housing having opposed plates, the plates being spaced apart and secured to each other by support arms;

a live bolt slidably mounted in the housing and horizontally actuated between an extended and a retracted position;

a live bolt hub mounted in the housing and contacting the live bolt to actuate the live bolt between the extended and retracted positions;

a slide mounted in the housing vertically above the live bolt hub and movable vertically between a first position disengaged from the live bolt and a second position engaging the live bolt, the slide including a contact arm, wherein the contact arm is flexible, is flexibly formed with the slide, and is coupled to the slide at only one end of the contact arm; arm a cam arranged and configured to engage the contact arm and move the contact arm towards the slide during rotation of the cam thereby actuating the slide between the first position and the second position, the cam being positioned in the housing vertically above the live bolt hub;

wherein in the first position, the live bolt is free to move between the extended and retracted positions, and in the second position, the slide locks the live bolt in the extended position.

* * * * *

UNITED STATES PATENT AND TRADEMARK OFFICE

CERTIFICATE OF CORRECTION

PATENT NO. : 7,010,946 B2
APPLICATION NO. : 10/441974
DATED : March 14, 2006
INVENTOR(S) : Hahn It is certified that error appears in the above-identified patent and that said Letters Patent is hereby corrected as shown below:

Col. 10, line 6, claim 13: "and a rail portion," should read --and a tail portion,--

Col. 10, line 22, claim 17: "and slide me" should read --and slide are--

Col. 10, lines 65-67, claim 21: "is flexibly formed with the slide, and is coupled to the slide at only one end of the contact arm; arm" should read --is integrally formed with the slide, and is coupled to the slide at only one end of the contact arm; and--

Signed and Sealed this

Twenty-second Day of August, 2006

JON W. DUDAS
*Director of the United States Patent and Trademark Office*